United States Patent [19]

Harmant

[11] 4,121,384

[45] Oct. 24, 1978

[54] GRINDING-PATH COMPENSATING DEVICE FOR CRACK AND FLAW REMOVING MACHINE

[75] Inventor: Michel Harmant, Neris les Bains, France

[73] Assignee: Etablissements Zelant, Gazuit, Montlucon, France

[21] Appl. No.: 809,809

[22] Filed: Jun. 24, 1977

[30] Foreign Application Priority Data

Jul. 1, 1976 [FR] France ..... 76 20070

[51] Int. Cl.[2] ..... B24B 7/00

[52] U.S. Cl. ..... 51/34 D; 51/33 R; 51/47

[58] Field of Search ..... 51/34 D, 50 H, 47, 33 R; 125/11 PH, 11 CC

[56] References Cited

U.S. PATENT DOCUMENTS

| | | | |
|---|---|---|---|
| 2,766,559 | 10/1956 | Pixley | 51/50 H X |
| 3,641,709 | 2/1972 | Gazuit | 51/34 D |

*Primary Examiner*—Harold D. Whitehead

*Attorney, Agent, or Firm*—Amster, Rothstein & Engelberg

[57] ABSTRACT

This device intended for crack removing machines comprising a frame structure, a post and a first fluid-actuated cylinder connected to a two-armed lever pivotally connected to an arm supporting the grinding wheel comprises a third cylinder connected in parallel to the first cylinder and having one point of its cylinder and another point at the end of its piston rod pivotally connected the former about a vertical axis fixed in relation to the frame structure of the machine and the latter about another axis fixed in relation to the post and not coincident with the pivot axis of this post.

1 Claim, 2 Drawing Figures

GRINDING-PATH COMPENSATING DEVICE FOR CRACK AND FLAW REMOVING MACHINE

BACKGROUND OF THE INVENTION

1. Field of the invention

The present invention relates to a compensation device capable of converting into a rectilinear path the normally curved path of the grinding wheel of a crack removing machine comprising a frame structure on which a post is mounted for pivotal movement about a vertical axis, this post having an integral radial arm pivotally supporting in turn at its outer end about a vertical axis, a bracket, and a two-armed lever fulcrumed intermediate its ends about a horizontal pivot pin carried by the bracket, said two-armed lever being pivotally connected via a first double-acting fluid-actuated cylinder to said bracket while a second end of said two armed lever is pivotally connected to another, separate arm supporting the grinding wheel.

2. Description of the prior art

Flaw-removing machines are widely used in steel mills for eliminating, by means of a rotary grinding wheel kept at a constant height and to which a rectilinear horizontal and preferably reciprocating movement of translation is imparted, the surface flaws, cracks or splits occurring in raw-cast steel parts. In crack removing machines of the type disclosed and illustrated in the U.S. Pat. No. 3,641,709 herein incorporated by reference the grinding wheel path compensation device adapted to control automatically the first fluid-actuated cylinder as a function of the movements accomplished by the radial arm of the post pivotally mounted on the frame structure of the machine in order to convert the normally curved path of the grinding wheel into a rectilinear path consists of another cylinder carried by the radial arm of said post and supplying hydraulic fluid in parallel to said first cylinder, the piston rod of said another cylinder engaging a cam rigid with the frame structure of the machine. Therefore, this compensation device involves the use of a cam and a four-roller follower mechanism associated with said cam. In addition to its relatively high cost, this known compensation device is objectionable on account of its fragility.

It is the essential object of the present invention to provide a path compensation device of the type broadly set forth hereinabove, which is both simpler and more economical, and also sturdier and therefore has a longer useful life, than hitherto known devices of this character, with the additional advantage of avoiding detrimental mechanical plays.

SUMMARY OF THE INVENTION

The path compensation device according to the present invention comprises essentially besides the first cylinder and another double-acting cylinder couplet in parallel to this first cylinder and having one point of its body and the outer end of its piston rod pivotally connected the former to a vertical pivot pin rigid with the frame structure of the machine and the latter to another vertical pivot pin rigid with said pivoting post and remote from the vertical pivot axis of this post.

A specific and exemplary form of embodiment of this invention will now be described in detail with reference to the attached drawing.

DESCRIPTION OF THE PREFERRED EMBODIMENT

Rotatably mounted about a vertical axis A on the frame structure H of a crack removing machine is a post P having a horizontal radial arm I. The outer end of this arm I has a vertical bore formed therein rotatably engaged by a pivot pin B rigid with a bracket J, a top point $B_1$ of a stud $BB_1$ of this bracket J being connected via a link K to a top point $A_1$ of a horizontal stud $AA_1$ rigid with the frame structure of the machine, so as to maintain said bracket in a constant direction irrespective of direction assumed by the horizontal arm I of post P. Fulcrumed to a horizontal pin C rigid with said bracket J is a two-armed lever L having its upper arm pivotally connected at E to the outer end of the piston rod $T_1$ of a first double-acting cylinder $V_1$ having its cylinder body pivotally mounted about a horizontal pin S carried by the upper portion of bracket J. The opposite or lower arm of lever L is pivotally connected at D to one end of a second arm M carrying at its opposite end the shaft F of the grinding wheel N. Preferably, the height of this wheel N is set by means of a second cylinder and piston unit $V_2$ interconnecting one point of arm M to an overlying front projection of bracket J, as shown.

Figure 1:
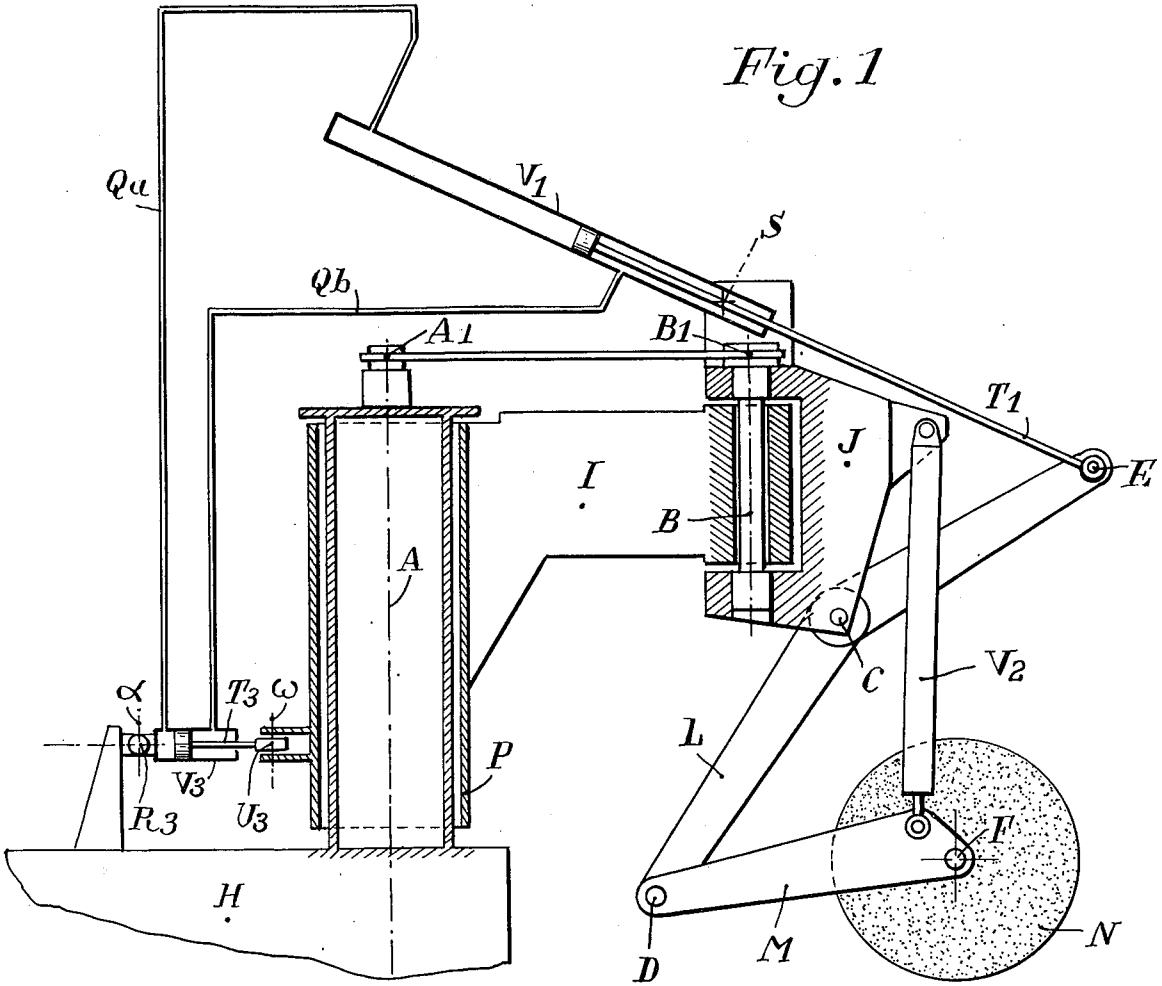
FIG. 1 is a diagrammatic side elevational view, with parts shown in axial vertical section, of the path compensation device according to this invention, mounted on a conventional crack removing machine.
Figure 2:
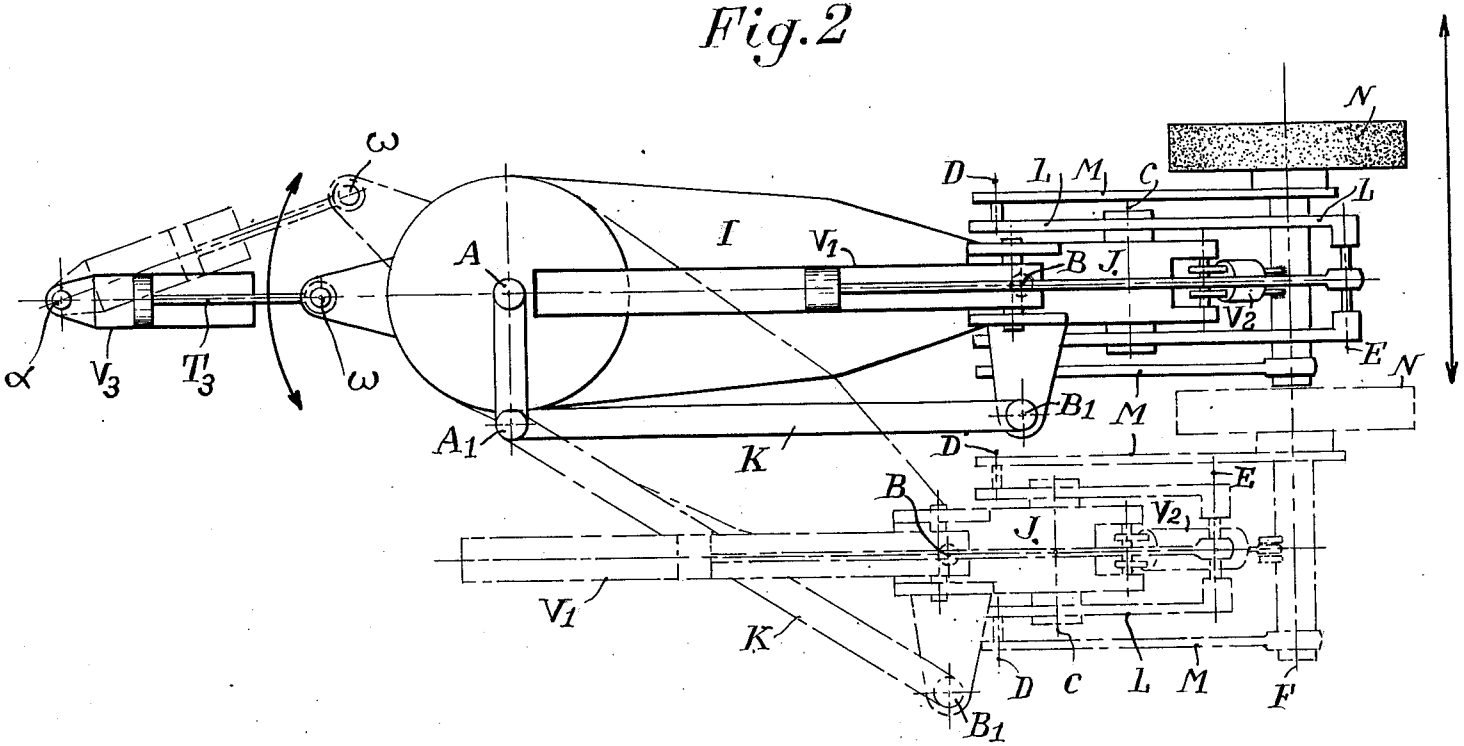
FIG. 2 is a diagrammatic plan view from above showing an assembly similar to the one illustrated in FIG. 1.

By operating two other cylinders (not shown) interconnecting two points rigid with the radial arm I to two points rigid with the frame structure of the machine, the pivotal movements of the post P and its radial arm I can be controlled at will. Each resulting angular movement of second arm M causes the grinding wheel N to perform a horizontal movement of translation (FIG. 2). If the actuator cylinder $V_1$ were not operated, this movement of translation would be a circular movement. To obtain as desired a rectilinear movement of translation of the grinding wheel, shown by an arrow on FIG. 2, the hydrostatic feed arrangement of cylinder $V_1$ is contemplated as illustrated in FIG. 1 and comprises; another double-acting cylinder $V_3$ connected in parallel to the first cylinder $V_1$ via conduits Qa and Qb, an end point $R_3$ of the body of this cylinder $V_3$ and an end point $U_3$ of the piston rod of the same cylinder $V_3$ being pivotally connected the former about a vertical pin $\alpha$ constituting a fixed vertical axis on the frame structure H of the machine, and the latter about another vertical axis $\omega$ fixed in relation to the pivoting post P and remote frame the axis A.

The distance $\alpha\omega$ varies when the post P pivots about the vertical axis A and the piston of cylinder $V_3$ is reciprocated in relation to the body of this cylinder $V_3$.

Because of the parallel fluid connection of cylinders $V_3$ and $V_1$, the piston of cylinder $V_1$ is also reciprocated in relation to the body of this cylinder according to the pivotal movement of the post P. Thus, when the radial arm I moves (phantom lines) from its intermediate position (continuous lines), the distance between pivot B and point E decreases and the distance between pivot B and point F increases, the incrementation of distance BF being such that the grinding wheel has a rectilinear translation movement (FIG. 2).

The cubic capacity of cylinder $V_3$ and the distance between centers $\alpha$ and A are calculated in a manner known per se so that the movements of the piston of this cylinder $V_3$ as a consequence of the rotation of post P will cause hydraulic fluid to be transferred into cylinder $V_1$ at such a rate that the path of grinding wheel N remains rectilinear.

In a particular embodiment of the present invention, the following dimensions can be used:

Inner diameter of $V_1$:80 mm
Diameter of $T_1$ = 56 mm
Inner diameter of $V_3$ = 80 mm
Diameter of $T_3$ = 56 mm
Distance between $\alpha$ and $\omega$ in the intermediate position (continuous lines on FIG. 2) : 642 mm
Distance $\alpha$A = 1000 mm
Distance AB = 1000 mm
Distance between point C and pivot or axle B:400 mm
Distance CE = 710 mm
Distance CD = 1150 mm
Distance DF = 750 mm
Distance between the upper end of $V_2$ and pivot B:670 mm
Length of $V_2$:from 1093 mm to 1743 mm.

Of course, the specific form of embodiment described and illustrated herein should not be construed as limiting the present invention, since various modifications will readily occur to those conversant with the art without departing from the basic principles of the invention as set forth in the appended claims.

What is claimed as new is:

1. A machine for removing surface cracks and flaws from steelwork products comprising a frame structure;

a post rotatably mounted on said frame structure about a vertical axis, said post having an integral horizontal radial arm with an outer end;

a bracket trunnioned about a vertical axis on said outer end of said horizontal radial arm;

a pair of studs, one of said studs being rigid with said frame structure and the other of said studs being rigid with said bracket;

a link interconnecting said studs and maintaining said bracket in a fixed direction;

a lever having an upper end and a lower end;

a first fluid-actuated double acting cylinder carried by said bracket and connected to said upper end of said lever;

a second arm having a first end and a second end, said second arm being pivotally carried by its said first end about a horizontal axis by said lower end of said lever;

means for connecting said second end of said second arm to said bracket;

a grinding wheel being rotatably mounted on said second end of said second arm; and a path compensating device controlling said first fluid-actuated cylinder with respect to a predetermined rotation of said post for imparting a corresponding rectilinear translation movement to said grinding wheel during said rotation, said compensating device comprising a second fluid-actuated double acting cylinder pivotally mounted between a point of said frame structure and a peripheral point of said post and coupled in parallel to said first fluid-actuated cylinder.

* * * * *